United States Patent [19]

Patrichi et al.

[11] Patent Number: 4,527,025

[45] Date of Patent: Jul. 2, 1985

[54] MINIATURE DELAY SWITCH

[75] Inventors: Mihai D. Patrichi, Los Angeles; Delbert L. Evanson, Mission Hills, both of Calif.

[73] Assignee: Networks Electronic Corp., Chatsworth, Calif.

[21] Appl. No.: 478,977

[22] Filed: Feb. 2, 1983

[51] Int. Cl.[3] ..... H01H 39/00

[52] U.S. Cl. ..... 200/61.08; 102/263; 337/401

[58] Field of Search ..... 200/61.08; 337/401; 102/262, 263, 264

[56] References Cited

U.S. PATENT DOCUMENTS 3,118,994 1/1964 Kabik ..... 337/401

3,155,800 11/1964 Denton ..... 200/61.08 X

*Primary Examiner*—A. D. Pellinen

*Assistant Examiner*—Morris Ginsburg

*Attorney, Agent, or Firm*—Munson H. Lane, Jr.

[57] ABSTRACT

A delayed action switch embodied in a tubular casing adapted to be incorporated in a missile or a guided projectile. For example, the Redeye missile is activated by a soldier who keeps it against his shoulder. As he pulls the trigger, the missile takes off toward a specific target such as a tank, truck or the like, a distance of a few seconds away from the soldier. Should the missile drop near the soldier and explode, the soldier would be killed; but with the delay switch of this invention incorporated in the missile, it would be deactivated before it hits the ground. Consequently, the missile would be a "dud", a non functional device. In general, the switch of our invention includes, in succession within a tubular casing, a priming charge which is ignited when the missile is first propelled into the atmosphere, and which fires an ignition charge which in turn ignites a delay charge. The latter, in turn, after a predetermined delay, ignites a base charge which acts against a piston to propel it at high speed forwardly, causing it to cut a circuit when the missile has attained a high elevation in its upward travel. In a modified form of the invention, the piston is adapted to establish a circuit at the end of the delay charge burning.

5 Claims, 2 Drawing Figures

MINIATURE DELAY SWITCH

OBJECT OF THE INVENTION

The invention has as its object to provide a miniature protective device which can be incorporated in a missile to deactivate it before it can explode near a soldier who has fired it.

THE PRIOR ART

The prior art is replete with devices adapted to be propelled high into the atmosphere and to be ignited at the zenith of their travel, as in the fireworks art. However, to the best of our knowledge, none of such devices are adapted to be incorporated in a missile for the purpose of protecting the person launching the missile.

RESUMÉ OF THE INVENTION

The invention provides a delayed action switch embodied in a miniature tubular casing which is adapted to be associated with a missile so as to deactivate it after a predetermined period of time such as to protect the person launching the missile.

IN THE DRAWINGS

FIG. 1 illustrates the invention in the form in which actuation results in the opening of a preexisting circuit; and FIG. 2 shows the invention in the form in which actuation results in closing a previously open circuit.

DETAILED DESCRIPTION OF THE INVENTION

Figure 1:
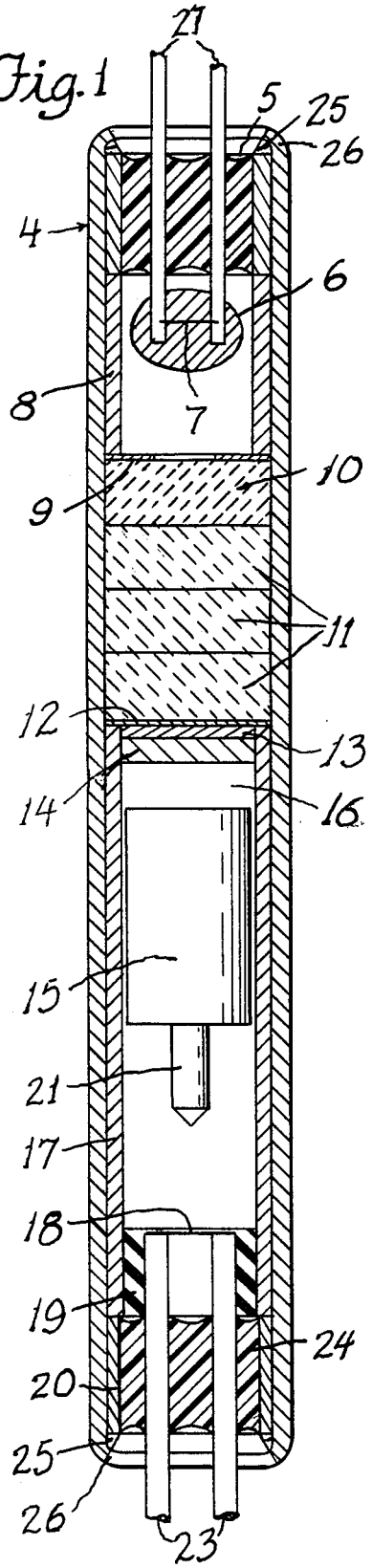

Referring now to FIG. 1, the invention utilizes a tubular housing 4 of metal or material of equal strength, a glass to metal seal 5 which is mounted in one end of housing 4 against the end of a sleeve 8 fitted in the housing around a priming charge 6, the latter being of a material that will be ignited by the ignition heating of the filament 7 therein. Both the ignition of priming charge 6 and the resulting expansion of the volume of gas, will contact the ignition charge 10 through the opening in the center of retainer washer 9, thus igniting the charge 10. The burning of ignition charge 10 wil ignite the first layer of delay charge 11, resulting in burning of all three layers of charge 11 in a predetermined interval of time. When the burning reaches the barrier disc 12, resulting in heating of the latter sufficiently to ignite the base charge 13, the latter will burn with explosive force, driving disc 14 across space 16 against the base of piston plunger 15 with sufficient force to cause its nose rod 21 to sever the filament 18 bridging between terminal rods 23, thus opening a preestablished circuit.

Figure 2:
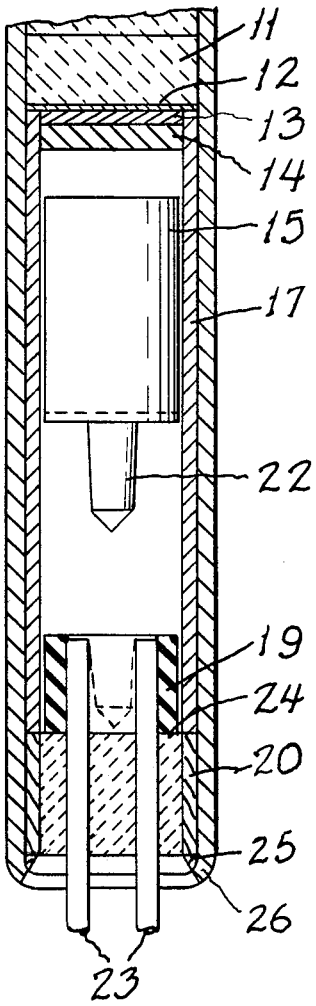

In the form of the invention shown in FIG. 2, in which all parts numbered 4 through 17 are the same as shown in FIG. 1, all steps described above will be executed with the exception of the circuit-opening severance of filament 18. Instead, the forward driving of plunger 15 will cause its projecting nose 22 to enter the space between terminal rods 23, contacting both rods sufficiently to establish a circuit through these rods, thus closing a previously open circuit.

Referring to both forms of the invention, the barrier disc 12 is supported by a liner sleeve 17, the end of which engages the rim of the disc. Base charge 13 is in face to face contact with disc 14—thus its entire explosive force will effectively drive the disc forwardly against plunger 15. Disc 14 is preferably of insulating material so as to react fully under the expanding gases of explosion. The body of plunger 15 is slidably fitted in sleeve 17 for free sliding movement, while disc 14 is fitted within liner sleeve 17 sufficiently closely to transmit all of the explosive force of base charge 13.

Sleeve 19 is of insulating material and embraces rods 23 sufficiently closely to hold them in fixed spacing such as to maintain tension on bridge wire 18 while preventing undue tension such as might result in breaking the wire prior to its severance by plunger nose 21. Nose 21 is of non-conductive material so that it will not reestablish a circuit that has been opened by severance of bridge wire 18. Rods 23 are fixed in properly spaced relation by an insulator block 24 through which they extend, block 24 in turn being enclosed in header sleeve 20 which is secured in the end of housing 4 by a ring of solder 25 supported by an inturned lip 26 at the end of the housing.

Ignition of priming charge 6 will be effected by the heat of the explosion which projects the missile in which the switch of our invention is embodied, the heat being transmitted through priming rods 27 mounted in a block of insulating material composing header 5. Alternatively, ignition may be effected by application of a direct current to priming rods 27, causing the bridge wire 7 to be heated so as to ignite the charge 6. In either event, the resulting hot gases will pass through the retainer 9 and ignite the charge 10, which in turn will ignite the delay charge 11. The latter will burn for a predetermined length of time, the caloric energy of which will heat the barrier 12 so as to ignite the base charge 13. This charge will explode and project the piston 15 to break the circuit (FIG. 1) or to make a circuit (FIG. 2). In the FIG. 2 form of the invention, the piston plunger 22 is of conductive material for establishing a circuit. In breaking the circuit of FIG. 1, the current will be interrupted and the missile will accordingly be disarmed, thus protecting a person in the vicinity.

We claim as our invention:

1. A miniature delay switch comprising a tubular housing; a leader comprising a block of insulating material fixed in one end of said housing; a pair of priming rods extending through and fixed in said header; a bridge wire extending between said fixed to inner end portions of said priming rods; a priming charge enclosing said bridge wire; an ignition charge adjacent said priming charge, adapted to be ignited by burning thereof; a delay charge adjacent said ignition charge, in position to be ignited by burning thereof and to burn throughout a delay period; a base charge adjacent the last to burn portion of said delay charge, said base charge being adapted to explode from ignition by said delay charge; a pair of terminal rods fixed in the other end of said housing; and a plunger slidable in said housing toward said terminal rods and adapted to advance toward the same under expansion of gas created by explosion of said base charge, and plunger having a nose pin adapted to enter between the inner ends of said terminal rods.

2. A miniature delay switch as defined in claim 1, including a filament bridging between inner ends of said terminal rods in position to be severed by said nose pin upon advance of said plunger, whereby to break a circuit involving said terminal rods, said nose pin being of non-conductive material.

3. A miniature delay switch as defined in claim 1, wherein said nose pin is of conductive material and is adapted to enter between and to establish contact with inner ends of said terminal rods and thereby to close a previously open circuit.

4. A miniature delay switch as defined in claim 1, including a sleeve within said housing around said priming charge; and a retainer disc engaged between the inner end of said sleeve and said ignition charge, said retainer disc having an opening through which the burning of said priming charge will ignite said ignition charge.

5. A miniature delay switch as defined in claim 1, including a liner sleeve within said housing, in which said plunger is slidable; a barrier disc between the last to burn portion of said delay charge and the adjacent end of said liner sleeve, said barrier disc being in face to face contact with said base charge; and a driving disc within said adjacent end of the liner sleeve, said driving disc being slidable in said adjacent end of the liner sleeve and adapted, in response to the explosion of said base charge, to drive said plunger toward said terminal rods.

* * * * *

UNITED STATES PATENT OFFICE

CERTIFICATE OF CORRECTION

PATENT NO. : 4,527,025

DATED : July 2, 1985

INVENTOR(S) : Mihai D. Patrichi & Delbert L. Evanson

It is certified that error appears in the above-identified patent and that said Letters Patent are hereby corrected as shown below:

Col. 1, line 44, change "wil" to --will--;

Claim 1,line 2, change "leader" to --header--.

Signed and Sealed this

*First* Day of *October 1985*

[SEAL]

*Attest:*

*Attesting Officer*

DONALD J. QUIGG

*Commissioner of Patents and Trademarks—Designate*